US008297213B2

(12) United States Patent
Liberg

(10) Patent No.: US 8,297,213 B2
(45) Date of Patent: Oct. 30, 2012

(54) SEA WATER SYSTEM AND FLOATING VESSEL COMPRISING SUCH SYSTEM

(75) Inventor: Lars-Olof Liberg, Strömstad (SE)

(73) Assignee: Kellogg Brown & Root LLC, Houston, TX (US)

( * ) Notice: Subject to any disclaimer, the term of this patent is extended or adjusted under 35 U.S.C. 154(b) by 248 days.

(21) Appl. No.: 12/689,847

(22) Filed: Jan. 19, 2010

(65) Prior Publication Data

US 2010/0180810 A1 Jul. 22, 2010

Related U.S. Application Data

(60) Provisional application No. 61/145,762, filed on Jan. 20, 2009.

(30) Foreign Application Priority Data

Jan. 20, 2009 (SE) ..... 0950019

(51) Int. Cl.
*B63B 39/03* (2006.01)

(52) U.S. Cl. ..... 114/125

(58) Field of Classification Search ..... 114/125
See application file for complete search history.

(56) References Cited

U.S. PATENT DOCUMENTS

| | | | | |
|---|---|---|---|---|
| 3,678,559 | A * | 7/1972 | Zilkalns | 29/281.6 |
| 4,166,426 | A * | 9/1979 | Lloyd, III | 114/65 R |
| 4,379,054 | A * | 4/1983 | Ayers | 210/242.3 |
| 4,471,708 | A | 9/1984 | Wilson et al. | |
| 4,678,439 | A * | 7/1987 | Schlichthorst | 440/11 |
| 4,715,309 | A * | 12/1987 | Liberg | 114/125 |
| 6,378,451 | B1 | 4/2002 | Welch et al. | |
| 2004/0131427 | A1 | 7/2004 | Wybro et al. | |

FOREIGN PATENT DOCUMENTS

| | | |
|---|---|---|
| GB | 2169570 | 7/1986 |
| GB | 2169864 | 7/1986 |
| JP | 2001018885 | 1/2001 |
| WO | 2005108301 | 11/2005 |
| WO | 2008139573 | 11/2008 |

* cited by examiner

*Primary Examiner* — Edwin Swinehart

(74) *Attorney, Agent, or Firm* — KBR IP Legal Dept.

(57) ABSTRACT

A sea water system comprises, an inlet conduit assembly, a ballast tank and an overflow arrangement arranged in fluid communication with the inlet conduit assembly. The inlet conduit assembly provides a fluid communication between ambient environment and the ballast tank. A first pump assembly is arranged in the inlet conduit assembly for pumping sea water through at least a first conduit portion towards the ballast tank. A second pump assembly is arranged in fluid communication with the ballast tank and is arranged for pumping sea water from the ballast tank through an outlet conduit assembly arranged after the second pump assembly. The second pump assembly and the outlet conduit assembly are separate from the inlet conduit assembly. The sea water system may be arranged on a floating vessel.

29 Claims, 10 Drawing Sheets

SEA WATER SYSTEM AND FLOATING VESSEL COMPRISING SUCH SYSTEM

CROSS REFERENCE TO RELATED APPLICATIONS

This application claims priority to Provisional Patent Application No. 61/145,762 which was filed on Jan. 20, 2009 and SE 0950019-0 which was filed on Jan. 20, 2009, the entirety of which is incorporated by reference herein.

BACKGROUND

1. Technical Field

On a floating vessel there is need for a system, which supplies sea water for various uses onboard. There are various aspects to such sea water systems and also to the vessels, on which the systems are arranged.

2. Background

On a floating vessel sea water, i.e. water ambient of the floating vessel, is used in many applications, such as ballasting, fire-fighting and as a cooling fluid. The floating vessel must have a suitably arranged system for supply of sea water. Requirements on such sea water systems are: high dependability, low risk of leakage, high priority consumers of sea water such as a fire fighting system must be prioritized over lower priority users, low susceptibility to damage, easy maintenance.

A floating vessel, such as a ship or a semi-submersible vessel, is often provided with one or more ballast systems in order to control the draught and/or the inclination of the floating vessel. Generally, a ballast system comprises a ballast tank, and in practice, often a plurality of ballast tanks. A ballast tank is adapted to be filled with sea water and when it is to be emptied, the sea water often is directed back to the ambient environment.

GB 2169864 discloses a ballast arrangement including a sea-chest, to which a pump is connected for pumping sea water through a conduit to a level above an uppermost ballast tank. From this level the sea water is distributed through a conduit to different ballast tanks. When a ballast tank is emptied the sea water is directed from the ballast tank back to the pump, which now is used for pumping the sea water overboard.

SUMMARY OF INVENTION

A sea water system comprises an inlet conduit assembly, a ballast tank and an overflow arrangement arranged in fluid communication with the inlet conduit assembly. The inlet conduit assembly provides a fluid communication between ambient environment and the ballast tank. A first pump assembly is arranged in the inlet conduit assembly for pumping sea water through at least a first conduit portion towards the ballast tank.

Safe distribution and handling of sea water is desired aboard a vessel or similar. It is aimed at avoiding a sea water system with large flow inside closed spaces of a vessel or similar and/or part thereof such as hull, float, column and deck box.

In the sea water system a second pump assembly is arranged in fluid communication with the ballast tank and is adapted for pumping sea water from the ballast tank through an outlet conduit assembly arranged after the second pump assembly. The second pump assembly and the outlet conduit assembly are separate from the inlet conduit assembly.

In such a sea water system sea water is fed into the system and discharged from the system independently. The first pump assembly can pump sea water into the system while the second pump simultaneously can pump sea water out of the system. Sea water fed into the sea water system will be readily available for different users aboard a vessel or similar, on which the sea water system is arranged. Simultaneously, the second pump assembly can pump sea water out of the ballast tank through the outlet conduit assembly arranged after the second pump assembly, seen in a direction of sea water flow.

Furthermore, the inlet conduit assembly being separate from the outlet conduit assembly also entails that the inlet conduit assembly can be dedicated for feeding sea water into the sea water system, which means few physical connections to the inlet conduit assembly. In practice, such physical connections would often be arranged below a still water surface of a vessel or similar, which is provided with the sea water system.

The overflow arrangement will extend to a vertical level and will thus determine a maximum sea water pressure in the system. The overflow arrangement is adapted to lead away water from a portion of the inlet conduit assembly extending from the first pump assembly to the ballast tank. Preferably, the overflow outlet discharges, indirectly or directly, into the environment ambient of the sea water system. As such, since the overflow arrangement is arranged in fluid communication with the inlet conduit assembly and the inlet conduit assembly provides a fluid communication between the ambient environment and the ballast tank, the maximum pressure (i.e. hydrostatic pressure) in the ballast tank will be determined by the largest level difference between the ballast tank and the overflow arrangement. Consequently, the maximum pressure in the ballast tank will be determined by the difference between the maximum vertical level of the overflow arrangement and the minimum vertical level of the ballast tank. As may be appreciated from the detailed description, the maximum vertical level of the overflow arrangement need not necessarily coincide with the overflow outlet. Instead, the overflow outlet may be located below, and thus downstream of, the maximum vertical level of the overflow arrangement.

The first pump assembly may comprise a first pump, which is adapted to pump sea water into the inlet conduit assembly. The first pump assembly could comprise one or more further pumps.

In the sea water system the inlet conduit assembly may comprise, in sequence, the first conduit portion, an intermediate branch portion and a second conduit portion. At least a further conduit assembly of the sea water system may branch off from the intermediate branch portion. This means that the first pump assembly will pump sea water to the intermediate branch portion. From the intermediate branch portion the second conduit portion leads towards the ballast tank but also a further user of sea water may be supplied with sea water through the further conduit assembly. The further user may for instance be a fire-fighting system or a general sea water supply conduit assembly aboard a vessel. The intermediate branch portion is a convenient position in the sea water system, from where the sea water may be distributed.

The second conduit portion may also lead to at least one further ballast tank. The second conduit portion may be directly or indirectly connected to the ballast tank and the at least one further ballast tank.

In the sea water system, the outlet conduit assembly may discharge liquid into the overflow arrangement without feeding the liquid to the inlet conduit assembly. Thus a common outlet for sea water from the sea water system may be arranged. The common outlet may either be at least partially constituted by the overflow arrangement or the overflow arrangement may in turn lead to an overboard arrangement for bringing the sea water back to an environment ambient to the vessel or similar, on which the sea water system is arranged. Alternatively, the outlet conduit assembly may lead to the overboard arrangement or directly to the ambient environment. As previously been mentioned, if an outlet conduit assembly is adapted to discharge liquid into the overflow arrangement, it is preferred that such a discharge does not result in that discharged liquid will be fed back to the ballast tank in order to prevent the introduction of possible contaminated liquid to the ballast tank. Moreover, in many embodiments of the present invention, it is preferred that the liquid is not fed back to the inlet conduit assembly. This is since it is desired that the inlet and outlet conduits are separate from one another in order to reduce the risk, and preferably prevent, that the possibly contaminated liquid in the outlet conduit assembly is introduced in the inlet conduit assembly and subsequently to the ballast tank.

In the sea water system the further conduit assembly may comprise a third pump assembly. The third pump assembly will make sure that sea water pressure in the further conduit assembly is sufficient for intended use of the sea water from the further conduit assembly. The third pump assembly will aid in pumping the sea water from the intermediate branch portion to a further user of sea water. For instance, in a fire-fighting system it must be assured that in all operating situations and operating positions of a vessel, the sea water supply and pressure will suffice for fire-fighting.

In the sea water system a fourth pump assembly may be arranged in the second conduit portion. The fourth pump assembly will make sure that in all operating situations and all operating positions sea water will reach the ballast tank.

The intermediate branch portion may be an intermediate tank adapted to hold sea water for further distribution. The intermediate tank will form a container, in which sea water is held. The intermediate tank thus acts as a buffer of sea water for different users of sea water connected to the intermediate tank. As such, if any one, or several, of the above users of sea water require an increased flow rate, this increase is provided by increasing the flow rate through the first pump assembly. Such an increase of the flow rate through the first pump assembly may for instance be obtained by starting an additional pump in the first pump assembly and/or increasing the rotation speed of at least one of the operating pumps in the first pump assembly. Generally, it will take some time to provide a flow rate through the first pump assembly which corresponds to—i.e. equals to or is greater than—the sum of the desired flow rates of the users of sea water. However, due to the presence of the intermediate tank, the desired (increased) flow rates for the users of water may be obtained almost instantly even though the supply of sea water to the intermediate tank is somewhat delayed.

The sea water may be held for a longer or shorter period of time depending on present need of sea water need of the different users. It is envisaged that the intermediate tank has a volume of 10-100 cubic meters, preferably 20-70 cubic meters. From the intermediate tank the sea water may be forwarded to reach an intended destination, such as different users e.g. the ballast tank, other ballast tanks, a fire-fighting system, a heat exchanger or a general sea water supply conduit assembly.

If required it is envisaged that the second conduit portion may comprise the fourth pump assembly being adapted to aid in transport of sea water from the intermediate tank to the ballast tank and/or other users. Similarly, the third pump assembly may pump sea water from the intermediate tank through the further conduit assembly.

In the sea water system the overflow arrangement may be connected to the intermediate tank. The overflow arrangement will thus form an outlet directly from the intermediate tank in case the inflow of sea water into the intermediate tank is larger than the discharge from the intermediate tank.

The overflow arrangement may be formed such that a first overflow level provides a first outflow area from the intermediate tank and a second overflow level provides a second outflow area from the intermediate tank, said second outflow area being greater than said first outflow area. In this way sea water may flow in a controlled amount through the overflow arrangement. When a sea water level inside the intermediate tank reaches the first overflow level, sea water flows out through the first outflow area. If sea water reaches the second overflow level the second overflow area ensures that any excessive amounts of sea water may flow through the overflow arrangement.

Moreover, the first and second outflow areas provide for that a flow rate through the overflow arrangement may be determined. How this is achieved will be discussed further in the detailed description hereinbelow.

The first outflow area may be formed by a recess in an upper edge of a portion of the overflow arrangement and/or formed by one or more through holes in a portion of the overflow arrangement.

The intermediate branch portion may be a manifold, from which the further conduit branches off, and wherein the first pump is adapted to pump sea water through the manifold and the second conduit portion to the ballast tank. In comparison with the intermediate tank, the manifold is not adapted to hold any significant amount of sea water if the first pump assembly is stopped. The manifold constitutes a branching position for conduits.

A floating vessel may comprise the sea water system mentioned above. The floating vessel comprises a hull forming part of an outer skin of the floating vessel. The floating vessel may for instanced be a semi-submersible vessel, such as e.g. an oil drilling platform. A semi-submersible vessel may have at least one float on which at least one column is arranged. The at least one column carries a deck box. At least one ballast tank is normally arranged in the float and/or column.

In the floating vessel a caisson may extend through a portion of the hull which is adapted to be located below a still water surface of the floating vessel, the caisson forming an integral part of the outer skin of the floating vessel. An arrangement according to the above provides for that the caisson may be protected from inter alia environmental loads, such as loads from waves and/or wind.

The floating vessel may comprise a substantially vertical column, inside which the caisson extends. The caisson extends through the hull and is of course securely attached to hull in a water tight manner, as such the caisson forms part of the outer skin and also the hull of the floating vessel. The caisson extending inside the column and thus inside the floating vessel does not change this fact. Extending inside the column, the caisson is protected against outside damage by icebergs, other vessels or similar.

The first pump assembly may comprise a submersible pump arranged in the caisson.

The caisson may form at least a part of the inlet conduit assembly. The first pump assembly will in this case pump sea water through the caisson itself. An alternative would be to have the first conduit portion extending inside the caisson.

The caisson may extend to the intermediate branch portion. The caisson will thus provide a passage from the hull of the vessel to the intermediate branch point.

The intermediate branch portion is suitably arranged above a still water surface of the floating vessel.

The caisson, the intermediate tank and the overflow arrangement may be connected so as to form part of the outer skin of the floating vessel. Sea water passing through the caisson into the intermediate tank and from there straight on through the overflow pipe has in essence only been pumped through a conduit, without having been subjected to environments aboard the vessel.

The intermediate branch portion may be arranged in a pump room of the floating vessel. The pump room may be a room, in which various parts of the sea water system are arranged for easy access. This will allow for easy maintenance and good supervision of essential parts of the sea water system.

The pump room may be arranged in the column of the floating vessel. Suitably the pump room may be situated directly below a deck box carried by the column.

In the pump room a heat exchanger for heat exchange between sea water and a further fluid may be arranged.

The third pump assembly may be arranged in the pump room.

A crane for lifting the first pump assembly may be arranged in the pump room. The crane would be used for various lifting operations inside the pump room. In particular, the crane would be used for lifting the first pump assembly or, in case the first pump assembly comprises a submersible pump, the submersible pump in and out of the caisson, the caisson suitably having an upper end in the pump room.

Several caissons extending downwards and through the hull of the vessel may be arranged next to each other in the pump room. First pump assemblies may be lifted in and out of the caisson using the crane. Spare pumps may be stored in the pump room for exchange of malfunctioning pumps in any of the caissons.

The caisson or several caissons may be provided with a respective top lid and/or bottom lid. A top lid would provide access to the caisson from above. A bottom lid for closing a caisson would facilitate maintenance of the caisson.

A lifting shaft may extend between the pump room and a level above the pump room. This could for instance be a level above the deck box. In that case the lifting shaft may extend through the entire deck box. Through the lifting shaft pumps, piping and other parts may be lifted from above down into the pump room.

The pump room may have an overflow outlet and/or a drain pump. In case of the pump room starting to become filled with water, the water may be discharged from the pump room. Thus avoiding that a water filled pump room will affect the floating vessel.

A bilge water system of the floating vessel may be connected to the second pump assembly, which is adapted for pumping bilge water through the outlet conduit assembly. A pump of the second pump assembly may pump bilge water from the floating vessel or to further bilge water handling. The second conduit assembly being separate from the inlet conduit assembly provides the advantage that bilge water will not contaminate the inlet conduit assembly and the sea water being supplied to the floating vessel.

Further features of, and advantages with, the present invention will become apparent when studying the appended claims and the following description. Those skilled in the art realize that different features of the present invention may be combined to create embodiments other than those described in the following, without departing from the scope of the present invention, as defined by the appended claims.

BRIEF DESCRIPTION OF THE DRAWINGS

The various aspects of the invention, including its particular features and advantages, will be readily understood from the following detailed description and the accompanying drawings, in which.

DETAILED DESCRIPTION

The present invention now will be described more fully with reference to the accompanying drawings, in which example embodiments are shown. However, this invention should not be construed as limited to the embodiments set forth herein. Disclosed features of example embodiments may be combined as readily understood by one of ordinary skill in the art to which this invention belongs. Like numbers refer to like elements throughout.

As used herein, the term "comprising" or "comprises" is open-ended, and includes one or more stated features, elements, steps, components or functions but does not preclude the presence or addition of one or more other features, elements, steps, components, functions or groups thereof.

As used herein, the term "and/or" includes any and all combinations of one or more of the associated listed items.

As used herein, the common abbreviation "e.g.", which derives from the Latin phrase "exempli gratia," may be used to introduce or specify a general example or examples of a previously mentioned item, and is not intended to be limiting of such item. If used herein, the common abbreviation "i.e.", which derives from the Latin phrase "id est," may be used to specify a particular item from a more general recitation.

The terminology used herein is for the purpose of describing particular embodiments only and is not intended to be limiting of the invention. As used herein, the singular forms "a", "an" and "the" are intended to include the plural forms as well, unless the context clearly indicates otherwise.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present.

Well-known functions or constructions may not be described in detail for brevity and/or clarity.

Figure 1:
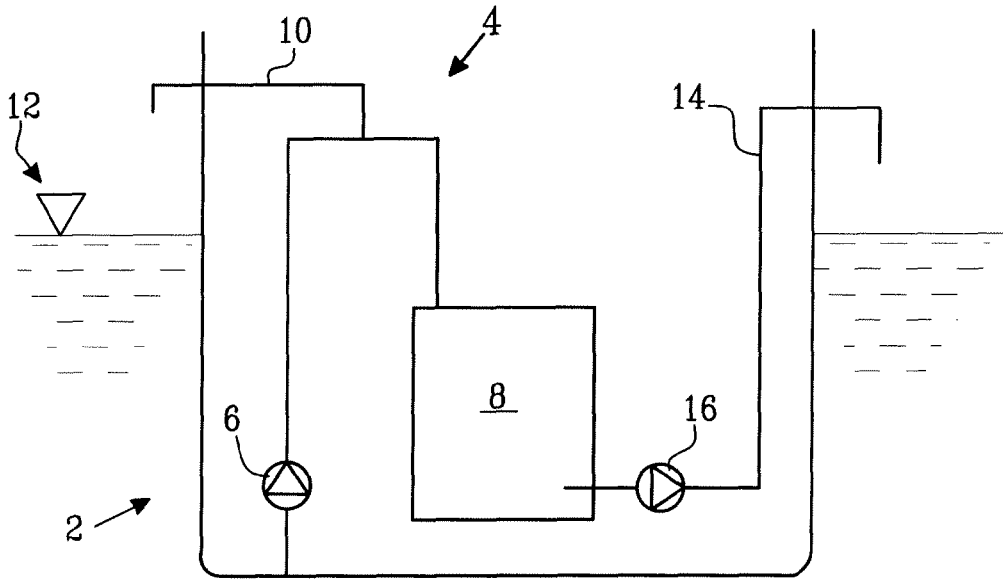
FIGS. 1 and 2 each schematically discloses a sea water system according to example embodiments aboard a floating vessel.

FIG. 1 schematically discloses a sea water system according to example embodiments aboard a floating vessel 2, such as a ship or any other floating unit. By way of example, the sea water system may be used in a semi-submersible vessel (not shown), i.e. a vessel having a deck and a float and one or more supporting columns connecting the deck and the float to one another. It should be noted that a floating vessel may be provided with a plurality of independent or communicating sea water systems. A semi-submersible vessel may be provided with one sea water system per supporting column. A semi-submersible vessel may have several positions of differing draughts. Two exemplary positions may be a transporting position and an operating position. In the transporting position the draught is low and the still water surface of the semi-submersible vessel may be in the range of the float. In the operating position the draught is deeper and the still water surface of the semi-submersible vessel may be somewhere along the column.

In an inlet conduit assembly 4 a first pump 6 is adapted to pump sea water from an environment surrounding the floating vessel 2 to a ballast tank 8. The highest level of the inlet conduit assembly 4 is above a still water surface of the floating vessel 2. The first pump 6 may be part of a first pump assembly comprising further components, such as valves and a further pump or more (not shown in FIG. 1).

An overflow arrangement 10 is connected to the inlet conduit assembly 4. The highest level of the overflow arrangement 10 determines the maximum water pressure in the ballast tank 8. The overflow arrangement 10 leads to outside the floating vessel 2, where overflowing sea water is discharged. The overflow arrangement 10 ends above the still water surface 12 of the water surrounding the floating vessel 2.

Preferably, the overflow arrangement 10 is adapted to provide a permanent fluid communication between the inlet conduit assembly 4 and the environment ambient of the sea water system. In other words, the overflow arrangement 10 is preferably void of e.g. valves or similar closing arrangements.

A second pump 16 is adapted to pump sea water from the ballast tank 8 through an outlet conduit assembly 14 arranged after the second pump 16 seen in the direction of sea water flow. The sea water is then preferably pumped back to the environment surrounding the floating vessel 2. The second pump 16 may be part of a second pump assembly comprising further components, such as valves and a further pump or more (not shown in FIG. 1). The inlet conduit assembly 4 and the outlet conduit assembly 14 are separate from each other.

Figure 2:
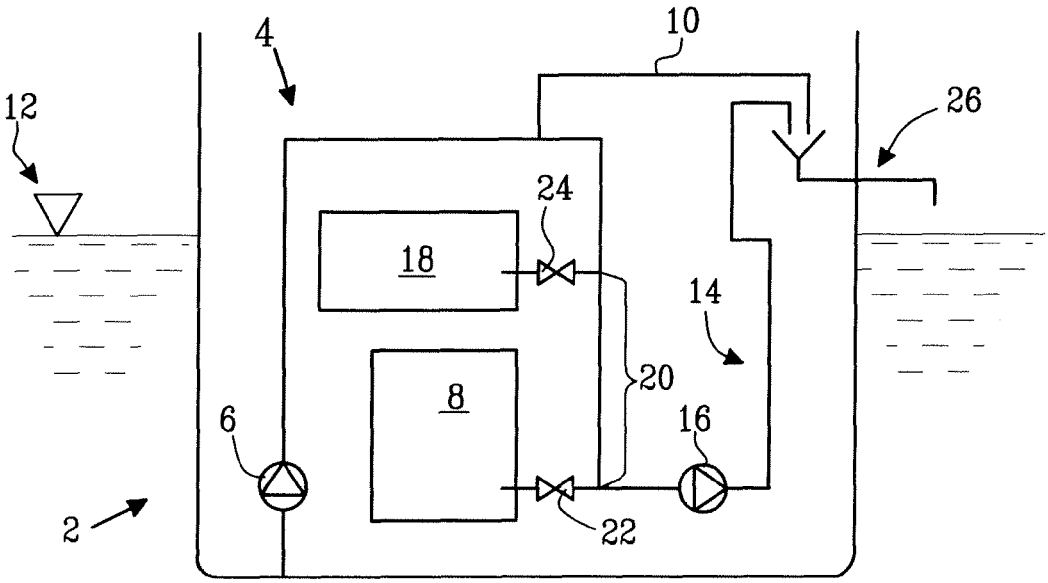

FIG. 2 schematically discloses a sea water system according to example embodiments aboard a floating vessel 2. An inlet conduit assembly 4 comprises a first pump 6 adapted to pump sea water to a first ballast tanks 8 and a second ballast tank 18. The inlet conduit assembly 4 further comprises a partial pipe section 20, from which a first pipe section with a first valve 22 extends to the first ballast tank 8 and a second pipe section with a second valve 24 extends to the second ballast tank 18.

An overflow arrangement 10 is connected to the inlet conduit assembly 4. The overflow arrangement 10 leads to an overboard arrangement 26, from which sea water is discharged from the floating vessel 2.

A second pump 16 is connected to the partial pipe section 20 of the inlet conduit assembly 4. The second pump 16 is followed by an outlet conduit assembly 14. A valve may be arranged in the outlet conduit assembly 14 close to the second pump 16. The outlet conduit assembly 14 is arranged to discharge sea water from the ballast tanks 8, 18 to the overboard arrangement 26.

The first pump 6 and the second pump 16 may be part of a respective pump assembly.

Figure 3:
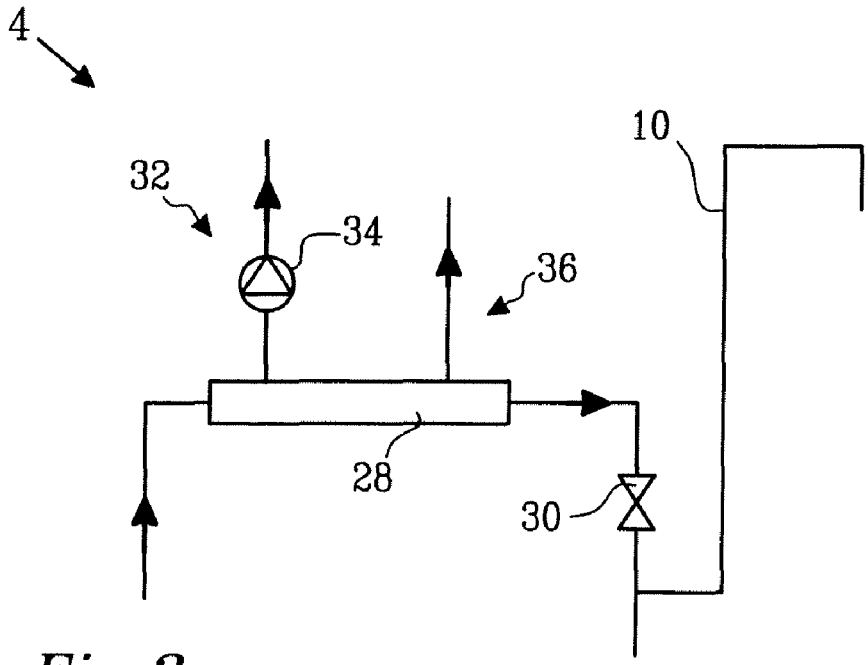
FIGS. 3-6 each schematically discloses part of an inlet conduit assembly of example embodiments.

FIG. 3 schematically discloses part of an inlet conduit assembly 4 of example embodiments. A non-shown first pump assembly is adapted to pump sea water to a manifold 28 forming part of the inlet conduit assembly 4. When valve 30 of the inlet conduit assembly 4 is open, the sea water is pumped to non-shown ballast tanks. To the manifold 28 there are also connected; a further conduit assembly 32 comprising a third pump assembly 34 for supplying sea water to a non-shown fire-fighting system and an additional conduit assembly 36. An overflow arrangement 10 is connected to the inlet conduit after the valve 30 and the level of the overflow arrangement 10 will determine the maximum sea water pressure in the ballast tanks.

By the third pump assembly 34 it is ensured that the fire-fighting system will be provided with sea water of sufficient pressure. In particular for a semi-submersible vessel in a transporting position, the deck is high above the still water surface of the vessel. If the first pump assembly is powerful enough to pump sea water up to the manifold 28, which could be arranged at a level below the deck of the semi-submersible vessel, the third pump assembly 34 will provide the additional water pressure required to transport the sea water up to deck level or above deck level, i.e. the highest level where fire-fighting might need to take place.

The further conduit assembly 32 of a sea water system might instead lead to a different user than a fire-fighting system.

Figure 4:
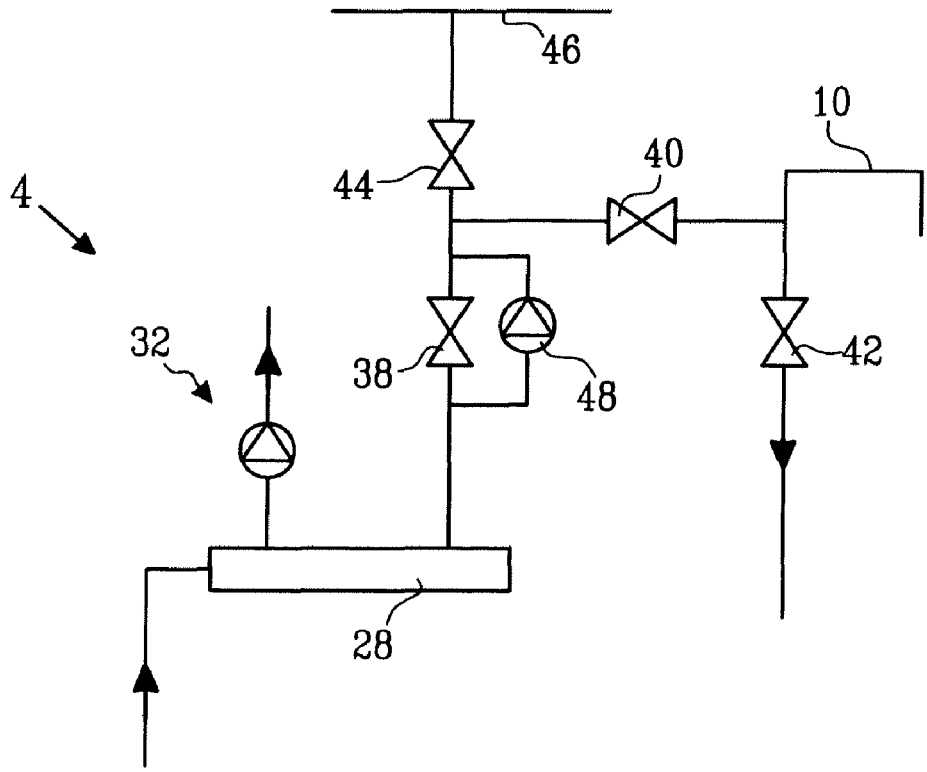

FIG. 4 schematically discloses part of an inlet conduit assembly 4 of example embodiments. A non-shown first pump assembly is adapted to pump sea water to a manifold 28 forming part of the inlet conduit assembly 4. As compared to the FIG. 3 embodiment, the inlet conduit assembly 4 now leads from the manifold 28 via first, second and third valves 38, 40, 42 to non-shown ballast tanks. Consequently, if the first pump assembly is in operation and the first, second and third valves are open, sea water is pumped to the ballast tanks. Through an overflow arrangement 10 overflowing sea water will be returned to the ambient environment. The level of the overflow arrangement 10 will also determine the maximum sea water pressure in the ballast tanks.

Following the first valve 38, there is a conduit comprising a fourth valve 44 leading to a main sea water distribution system 46, alternatively called a general sea water supply conduit assembly, for instance at deck level. If the main sea water distribution system 46 is above the manifold 28 a fourth pump assembly 48 might be required to lift the sea water from the manifold 28 to the main sea water distribution system 46. The fourth pump assembly 48 is arranged in a second conduit portion of the inlet conduit assembly 4. The second conduit portion may be considered to either be solely the conduit portion, in which the fourth pump assembly 48 is arranged or both the conduit portion, in which the fourth pump assembly 48 is arranged and the parallel conduit portion comprising the first valve 38. The first valve 38 might in this case be closed or it might be constituted by a non-return valve. The fourth pump assembly 48 is suitably used in a semi-submersible vessel when the vessel is in a transporting position. In this position the water pressure provided by the first pump assembly might not be high enough to transport sea water all the way up to deck level. When the vessel is in an operating position, the fourth pump assembly 48 might not be required and could be switched off. Since the still water surface of the vessel in this position is higher up on the vessel, the water pressure provided by the first pump assembly could be sufficient to provide the main sea water distribution system 46 at deck level with sea water.

The concept of a boosting pump, similar to the fourth pump assembly 48, for increasing water pressure in sea water conduits at different levels can be applied for all sorts of sea water users.

Figure 5:
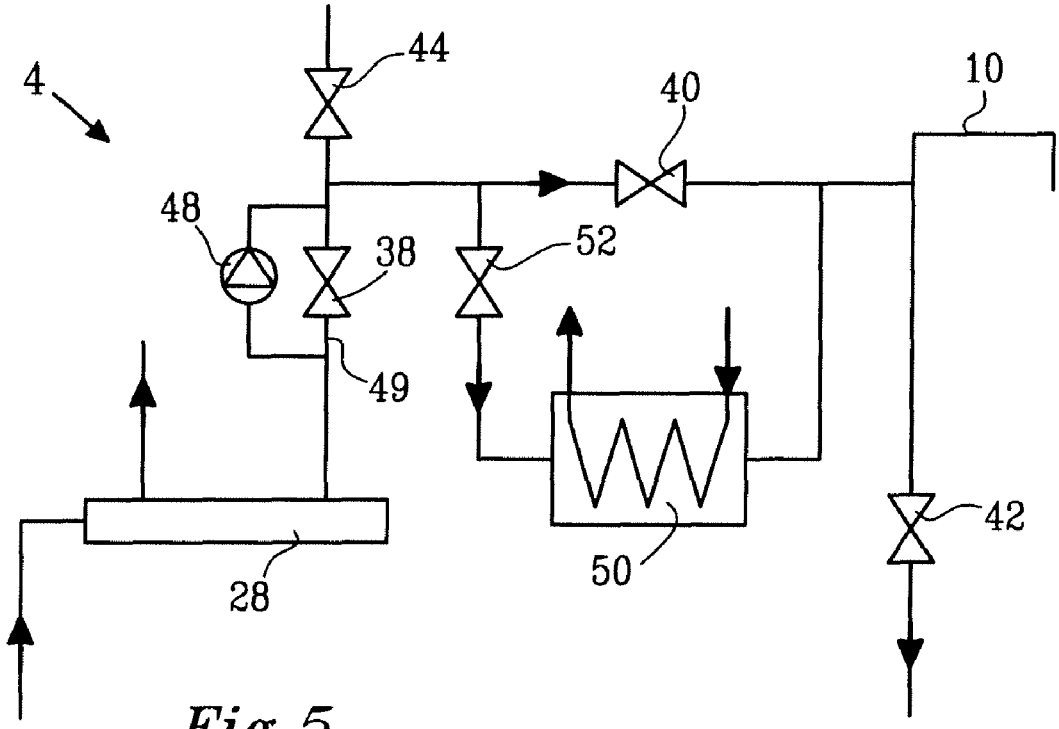

FIG. 5 schematically discloses part of an inlet conduit assembly 4 of example embodiments. A non-shown first pump assembly is adapted to pump sea water to a manifold 28 forming part of the inlet conduit assembly 4. The inlet conduit assembly 4 leads from the manifold 28 via first, second and third valves 38, 40, 42 to a non-shown ballast tank. Consequently, if the first pump assembly is in operation and the first, second and third valves 38, 40, 42 are open, sea water is pumped to the ballast tank. Through an overflow arrangement 10 overflowing sea water will be returned to the ambient environment. The level of the overflow arrangement 10 will also determine the maximum sea water pressure in the ballast tank.

Following the first valve 38, which in this case suitably may be a non-return valve, there is a conduit comprising a fourth valve 44 leading to e.g. a non-shown main sea water distribution system. A fourth pump assembly 48 is arranged in a second conduit portion of the inlet conduit assembly 4. The second conduit portion may be considered to either be solely the conduit portion, in which the fourth pump assembly 48 is arranged or both the conduit portion, in which the fourth pump assembly 48 is arranged and the parallel conduit portion 49.

As compared to the FIG. 4 embodiment, a heat exchanger 50 adapted for heat exchange between sea water and a further fluid is arranged in the sea water system. The heat exchanger 50 is arranged in a parallel conduit of the inlet conduit assembly 4. By closing the second valve 40 and opening a fifth valve 52, sea water is directed through the heat exchanger 50, which in this situation may form part of the inlet conduit assembly 4. If sea water is to be directed to the ballast tank, the third valve 42 is open. If no sea water is required for the ballast tank, the third valve 42 is closed and water flowing through the heat exchanger 50 will discharge through the overflow arrangement 10.

Alternatively or in addition to the function described in relation to FIG. 4, the fourth pump assembly 48 may be used to provide a suitable flow of sea water through the heat exchanger 50. Such a suitable flow of sea water depends on amount of heat to be transferred in the heat exchanger 50 and the flow resistance in the heat exchanger 50.

The manifolds 28 disclosed in FIGS. 3-5 constitute intermediate branch portions of inlet conduit systems 4. A first pump assembly is adapted for pumping sea water to a manifold 28, the first pump assembly may comprise one or several first pumps each of them adapted to pump sea water through a first conduit portion to the manifold 28.

Figure 6:
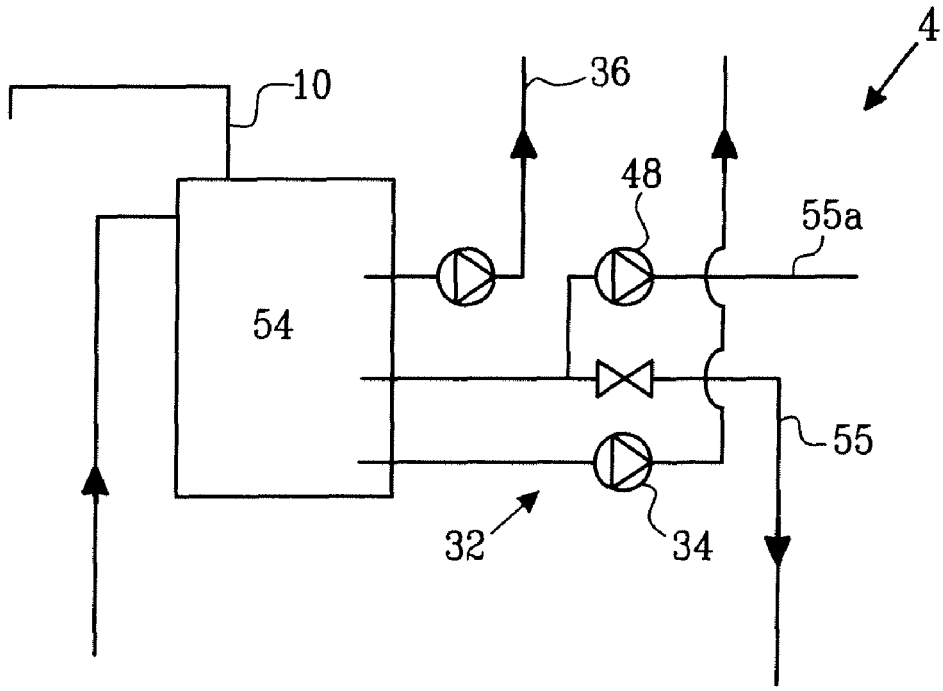

FIG. 6 schematically discloses part of an inlet conduit assembly 4 of example embodiments. An intermediate branch portion of the inlet conduit assembly 4 comprises an intermediate tank 54. In fact, in FIG. 6 the branch portion is constituted by the intermediate tank 54. A non-shown first pump assembly is adapted to pump sea water to the intermediate tank 54. The inlet conduit assembly 4 leads via a second conduit portion 55 to at least one non-shown ballast tank. A fourth pump assembly 48 is not necessary but could be arranged in the second conduit portion 55, for instance as shown, in an additional branch 55*a* of the second conduit portion 55. This additional branch 55*a* is connected to one or more ballast tanks (not shown) located above or on the same level as the intermediate tank 54. Preferably, the additional branch 55*a* comprises an additional overflow arrangement (now shown). Sea water may also flow through an overflow arrangement 10 back to the ambient environment. The level of the overflow arrangement 10 will determine the maximum sea water pressure in the ballast tank.

A further conduit assembly 32 comprising a third pump assembly 34 is arranged to supply a fire-fighting system with sea water. The further conduit assembly 32 connects to the intermediate tank 54 at a level below other users of sea water to ensure that sea water supply to the fire-fighting system is prioritized over the other users. An additional conduit assembly 36 is arranged to provide sea water to one or more additional users.

Figure 7:
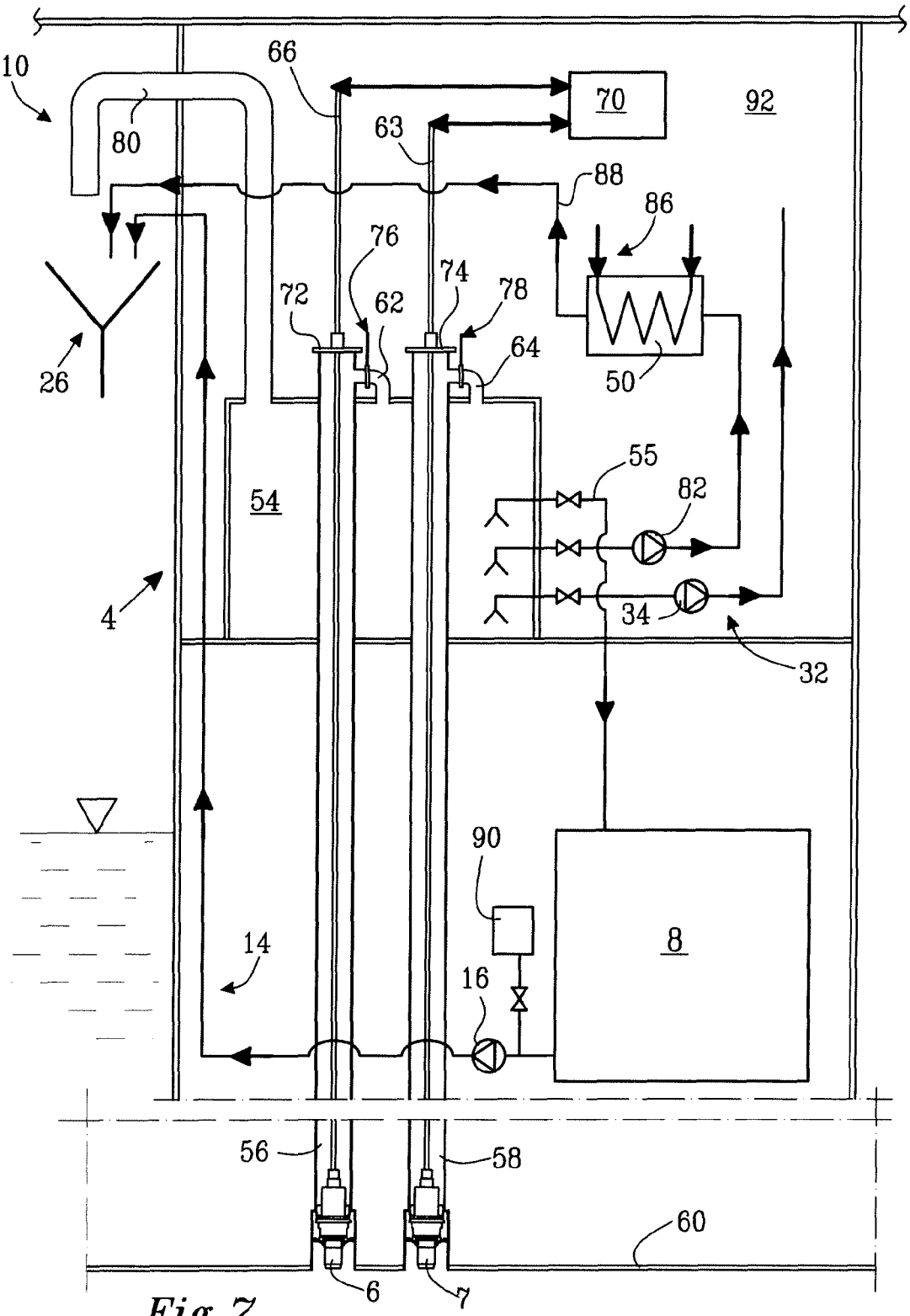
FIG. 7 discloses schematically a section through a floating vessel of example embodiments.

FIG. 7 discloses schematically a section through a floating vessel according to example embodiments. The floating vessel comprises a sea water system. An inlet conduit assembly 4 comprises two caissons 56, 58 extending vertically from a bottom portion of a hull 60 of the floating vessel, an intermediate branch portion in the form of an intermediate tank 54 and a second conduit portion 55 leading to a ballast tank 8.

At their lower ends the caissons 56, 58 are in open communication with ambient sea water and at their upper ends the caissons are connected to the intermediate tank 54. A curved pipe 62, 64 connects each caisson 56, 58 with the intermediate tank 54 at the upper side of the tank 54. One first pump 6, 7 is arranged at a lower end of each caisson 56, 58. The first pumps 6, 7 may be submersible centrifugal pumps, which are hydraulically driven by hydraulic power supplied through hydraulic conduits 66, 68 from a hydraulic power unit 70. Optionally, the pumps may be electrically driven.

There is placed a top lid 72, 74 on each caisson 56, 58. Each top lid 72, 74 has a through connection for the hydraulic conduits 66, 68 leading to the first pumps 6, 7. A top lid 72, 74 is opened e.g. when a first pump 6, 7 is to be submerged in a caisson 56, 58 or when a first pump 6, 7 is to be lifted from a caisson 56, 58. At the upper end of each caisson 56, 58, between each caisson 56, 58 and a respective curved pipe 62, 64, a valve 76, 78, for instance a butterfly valve, is arranged. Optionally, the butterfly valves may be replaced by spectacle flanges.

At an upper side of the intermediate tank 54 an overflow arrangement 10 in the form of an overflow pipe 80 is connected. The overflow pipe 80 extends upwards from the intermediate tank 54. The vertical height of the overflow pipe 80 decides the maximum pressure, which can build up inside the ballast tank 8.

The first pumps 6, 7 inside the caissons 56, 58 pump sea water up through the caissons 56, 58 to the intermediate tank 54. The top lid 72, 74 of each caisson 56, 58 aid in directing the sea water into the intermediate tank 54. By means of the valves 76, 78 the connection between a corresponding caisson 56, 58 and the intermediate tank 54 can be closed. By closing the valve 76 of caisson 56 its top lid 72 can be opened, e.g. for removing the first pump 6 from the caisson 56, without having to stop the first pump 7 in the other caisson 58 from pumping sea water to the intermediate tank 54. Also, if the caissons 56, 58 extend one or several meters above the intermediate tank 54, there is less risk of sea water splashing out from the intermediate tank 54 when a caisson 56, 58 is open. Another advantage of having the caissons 56, 58 extending one or several meters above the intermediate tank 54 is that there may a reduced risk of having water splashing out of the caissons 56, 58 themselves due to a high water level in the caissons 56, 58. Such a high water level may for instance be occasioned by a an inclination of the vessel and/or due to a water pressure—e.g. a wave pressure—being built up at the lover ends of the caissons 56, 58.

From the intermediate tank 54 and through the second conduit portion 55 of the inlet conduit assembly, the sea water reaches the ballast tank 8. When sea water is to be removed from the ballast tank 8, a second pump 16 and an outlet conduit assembly 14 is utilized. The second pump 16 is arranged to pump the water from the ballast tank 8 back to the environment surrounding the floating vessel.

It should also be noted that the water is transferred from the intermediate tank 54 to the ballast tank 8 by means of gravity which requires that the ballast tank 8 is located below the intermediate tank 54. However, a marine structure may also comprise one or more ballast tanks (not shown) being located on the same level as—or even above—the intermediate tank level 54. In order to fill such ballast tanks, the water system preferably comprises an additional ballast water assembly (not shown) with a ballast pump assembly (not shown). The additional ballast water assembly may then preferably comprise a separate overflow arrangement (not shown).

From the intermediate tank 54, sea water is also provided to further users of sea water. A further conduit assembly 32 with a third pump assembly 34 provides sea water to a fire-fighting system. A fifth pump 82 pumps sea water through a heat exchanger 50 for heat exchange with a further fluid 86. From the heat exchanger 50 the sea water flows back to the surrounding environment of the floating vessel through an outlet pipe 88.

The outlet pipe 88 of the heat exchanger 50, the outlet conduit assembly 14 from the ballast tank 8 and the overflow pipe 80 of the intermediate tank 54 could all separately discharge sea water to the ambient environment but in this case they all lead to an overboard arrangement 26, from which the sea water is brought back to the ambient environment.

Due to the vertical order of outlets from the intermediate tank 54, the fire-fighting system always has sea water available as long as there is sea water in the intermediate tank 54. Sea water to the heat exchanger 50 is second in priority and sea water to the ballast tank 8 has the lowest priority.

Since the intermediate tank 54 and the overflow pipe 80 are intimately connected with the caissons 56, 58, even though forming inner spaces, they can be considered to form part of the outer skin of the floating vessel. This means that sea water passing through the caissons 54 into the intermediate tank 56, 58 and from there straight on through the overflow pipe 80 would be considered to never have been taken aboard the floating vessel.

A first pump 6, 7 arranged at a lower end of a caisson 56, 58 may be part of a first pump assembly. The second pump 16 may be part of a second pump assembly. The second pump assembly may comprise connections to a bilge water system 90 adapted for removing bilge water from the floating vessel. The second pump 16 may in this case also be used for pumping bilge water.

FIG. 7 shows that many parts of the sea water system may be arranged in a pump room 92 of the floating vessel, such parts for instance being: the intermediate tank 54, the upper ends of the caissons 56, 58 with associated elements, the third and fifth pump 34, 82, the heat exchanger 50 and the hydraulic power unit 70.

Figure 8:
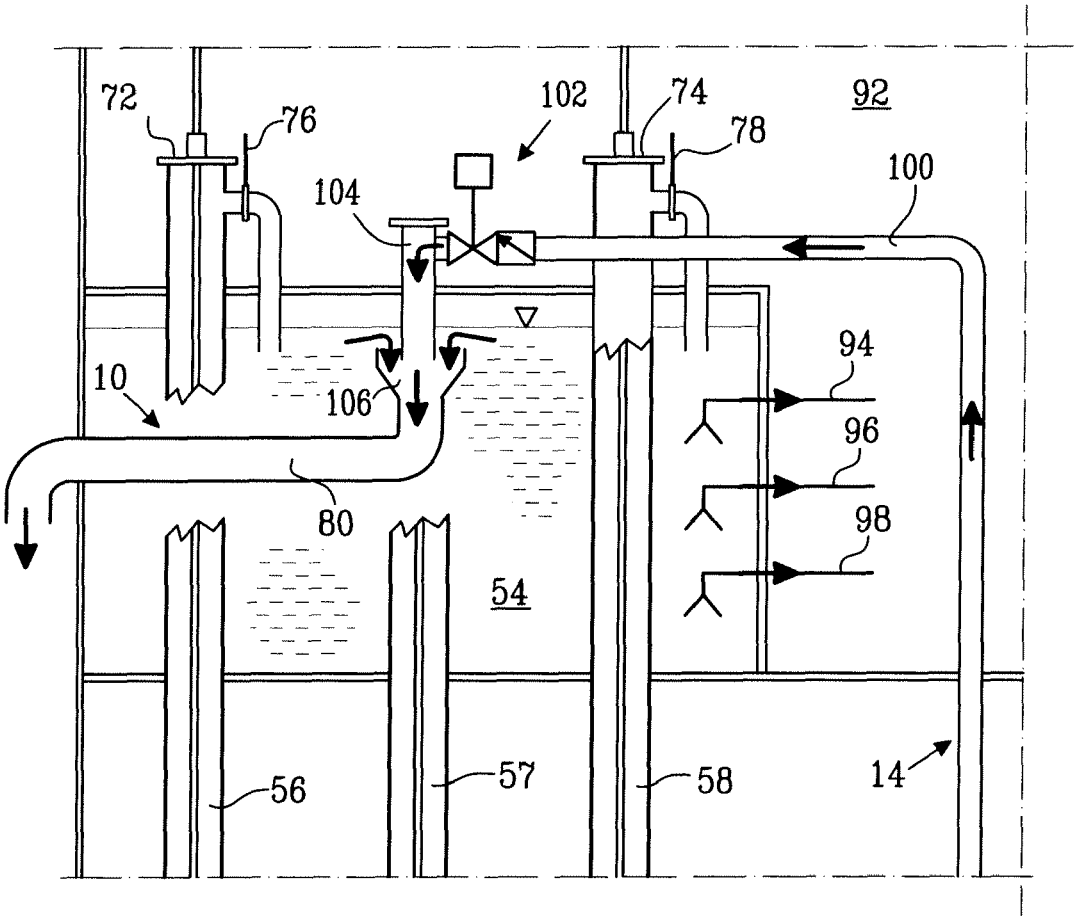
FIG. 8 discloses schematically a part of a sea water system according to example embodiments.

FIG. 8 discloses schematically a part of a sea water system according to example embodiments. An intermediate tank 54 is arranged in a pump room 92 and is part of an inlet conduit assembly. Three caissons 56, 57, 58 lead to the intermediate tank 54. The intermediate tank 54 has three outlets 94, 96, 98 for distributing sea water to different destinations such as ballast tank, fire-fighting system, heat exchangers and main sea water distribution system. From the ballast tank an outlet conduit assembly 14, comprising a return pipe 100, leads to the pump room 92. Similar to disclosure of FIG. 7, top lids 72, 74 can be removed from the caissons 56, 58 without any risk of sea water spilling from the intermediate tank 54 into the pump room 92 thanks to the provision of valves 76, 78, by means of which a connection between a caisson 56, 58 and the intermediate tank 54 can be interrupted.

Referring to FIGS. 7 and 8; valves 76, 78 and corresponding valves in any additional caissons are the only valves in the inlet conduit assembly before the intermediate tank 54, i.e. a respective caisson extends uninterruptedly from the bottom of a hull of a floating vessel to above a still water surface of the floating vessel. The only moving part below the still water surface being a respective first pump submersed inside the caisson. Thus, no leakage prone joints are present in a caisson beneath the still water surface of the vessel.

Referring to FIG. 8; an overflow arrangement 10 determines the maximum sea water level 101 inside the intermediate tank 54 and thus also the maximum sea water pressure in the ballast tank arranged below the pump room 92.

A valve assembly 102 and a discharge outlet 104 connect the return pipe 100 to the intermediate tank 54. The valve assembly 102 comprises a non-return valve to make sure that sea water from the intermediate tank 54 can not flow through the return pipe 100 to the ballast tank. The discharge outlet 104 ends inside the intermediate tank 54 above the overflow arrangement 10.

As such, the FIG. 8 embodiment of the present invention comprises an outlet conduit assembly 14 adapted to discharge liquid into the overflow arrangement 10 without feeding the liquid to the inlet conduit assembly and consequently not to the ballast tank 8. In the FIG. 8 embodiment, this effect is achieved by the position and extension of the discharge outlet 104 in relation to the overflow arrangement 10. Other embodiments of the present invention enabling the outlet conduit assembly 14 to discharge liquid into the overflow arrangement 10 but avoiding that the liquid is fed to the ballast tank 8 are illustrated with reference to FIG. 9 and FIG. 10 hereinbelow.

The overflow arrangement 10 comprises a funnel 106 and an overflow pipe 80. The funnel 106 is arranged below the discharge outlet 104 such that sea water pumped from the ballast tank is directed into the funnel 106 to flow outside the floating vessel through the overflow pipe 80. In essence the overflow arrangement 10 of the discharge tank 54 forms an outlet for the sea water coming from the ballast tank.

The caissons 56, 57, 58 disclosed in FIGS. 7 and 8 may either extend next to the intermediate tank 54 inside the pump room 92 or through the intermediate tank 54.

Figure 9A:
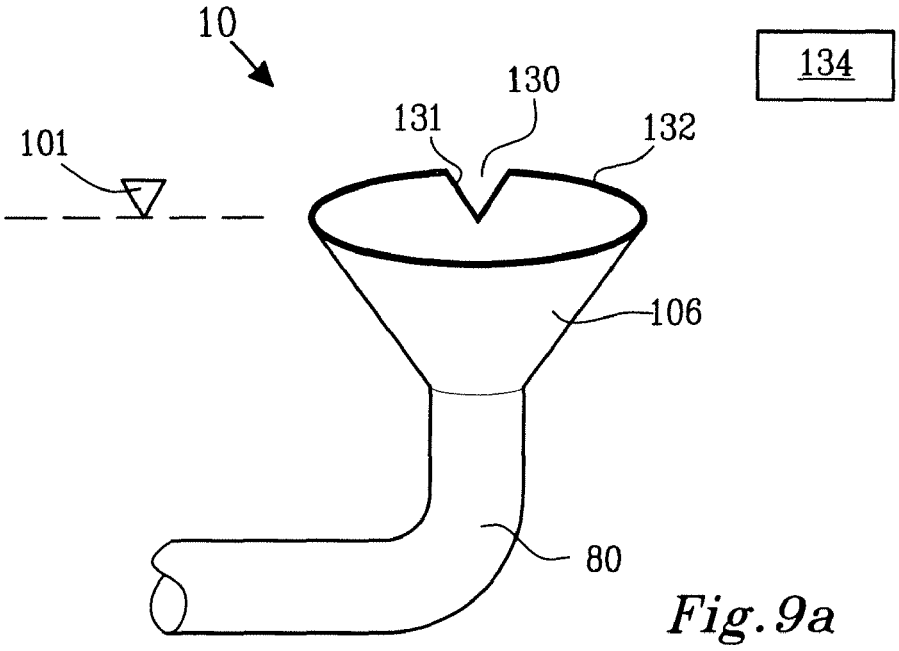
FIGS. 9*a*, 9*b* and 9*c* disclose overflow arrangements of example embodiments.
Figure 9B:
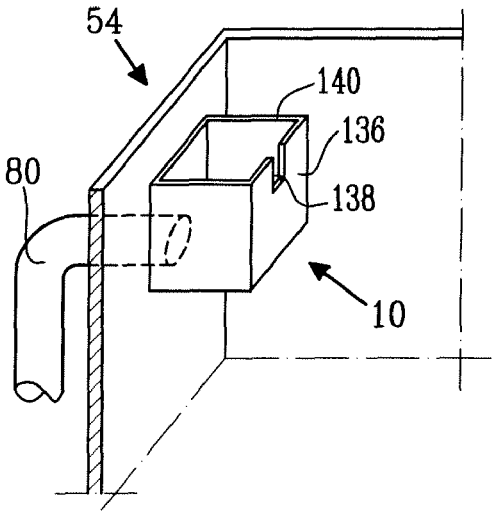
Figure 9C:
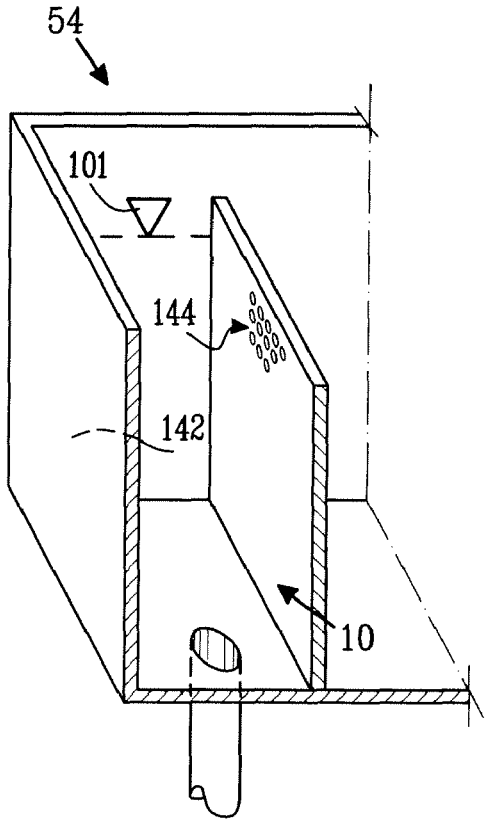

FIGS. 9*a*, 9*b* and 9*c* disclose overflow arrangements 10 of example embodiments. The general principle is to have control over inflow of sea water and the sea water level inside an intermediate tank by means of a controlled outflow of sea water from the intermediate tank through an overflow arrangement. The overflow arrangements are formed such that a first overflow level provides a first outflow area for sea water flowing out from the intermediate tank and a second overflow level provides a second outflow area for sea water flowing out from the intermediate tank.

Referring to FIG. 9*a*; a part of an overflow arrangement 10 adapted to be arranged inside an intermediate tank of a sea water system is shown. A funnel 106 is connected to an overflow pipe 80. The funnel 106 is provided with a V-shaped recess 130 such that an upper circumferential edge of the funnel 106 will extend along a non-horizontal line. Along the recess 130 a recess edge 131 will be at lower level than along an upper funnel edge 132. A cross section area of the V-shaped recess 130 provides a first outflow area at a first overflow level, i.e. a sea water level in the intermediate tank. As long as a sea water level 101 inside the intermediate tank is within the range of the V-shaped recess 130 a flow (amount per time unit) of sea water out from the intermediate tank can easily be estimated. If the sea water level inside the intermediate tank should rise above the upper funnel edge 132, forming a second overflow level, a second outflow area larger than the first outflow area is available for the sea water.

A first pump assembly pumping sea water into the intermediate tank can thus be controlled to provide a flow of sea water into the intermediate tank which will provide an appropriate flow of sea water through the V-shaped recess 130 into the funnel 106 of the overflow arrangement 10. The required total flow of sea water into the intermediate tank is of course depending on an outtake of sea water from the intermediate tank to different users. However, as long as flow of sea water through the overflow arrangement 10 takes place through the V-shaped recess, i.e. the first outflow area, and not over the upper funnel edge 132, oversupply of sea water to the intermediate tank is kept within reasonable limits. At the same time it is ensured that the intermediate tank is filled such that sea water is available for different users. Energy is saved by not pumping uncontrollable amounts of sea water directly through the intermediate tank to the overflow arrangement 10. (In case of a straight circumferential edge at the same horizontal level it is difficult to estimate or calculate a flow out of the intermediate tank. In that case there can essentially only be distinguished between two situations, either there is a flow out of the intermediate tank or there is no flow out of the intermediate tank.)

A sea water level sensor 134 may be provided in the intermediate tank to establish a sea water level. For instance the sensor 134 may be used to verify that the sea water level 101 inside the intermediate tank is within the range of the V-shaped recess 130 or the sensor 134 could be used to establish the actual level of sea water inside the intermediate tank and thus make possible a more accurate control of the sea water level inside the intermediate tank, e.g. by providing a measure of how high the sea water level 101 is in relation to the bottom of the V-shaped recess 130.

Referring to FIG. 9*b*; an overflow arrangement 10 comprising an outlet container 136 and an overflow pipe 80 is arranged in an intermediate tank 54. The outlet container 136 is provided with a rectangular recess 138, which forms a first outflow area. The overflow arrangement 10 functions in the same manner as described in relation to FIG. 9*a*.

Referring to FIG. 9*c*; an overflow arrangement 10 comprising an outlet compartment 142 arranged in an intermediate tank 54 is shown. An overflow pipe 80 is connected to the outlet compartment 142. A wall portion of the outlet compartment 142 is provided with a number of through holes 144. As the sea water level rises inside the intermediate tank 54, the sea water reaches the through holes 114 and will start to flow into the outlet compartment 142 through the through holes 144. The though holes 144 have a known area and thus a flow of sea water from the intermediate tank 54 into the outlet compartment 142 can be estimated based on how high the sea water level 101 is inside the intermediate tank 54, i.e. how many holes are beneath the sea water level 101. The through holes 144 provide a first outflow area. Other than utilizing through holes 144 instead of a recess in an upper edge, the overflow arrangement 10 functions in the same manner as described in relation to FIG. 9*a*.

It is of course understood that in any one of the overflow arrangements 10 disclosed in FIGS. 9*a*, 9*b* and 9*c* the V-shaped recess 130, the rectangular recess 138 or the through holes 144 may be used. Other shaped recesses, a single through hole or a non-horizontal edge, e.g. a leaning edge may alternatively be used.

Figure 10:
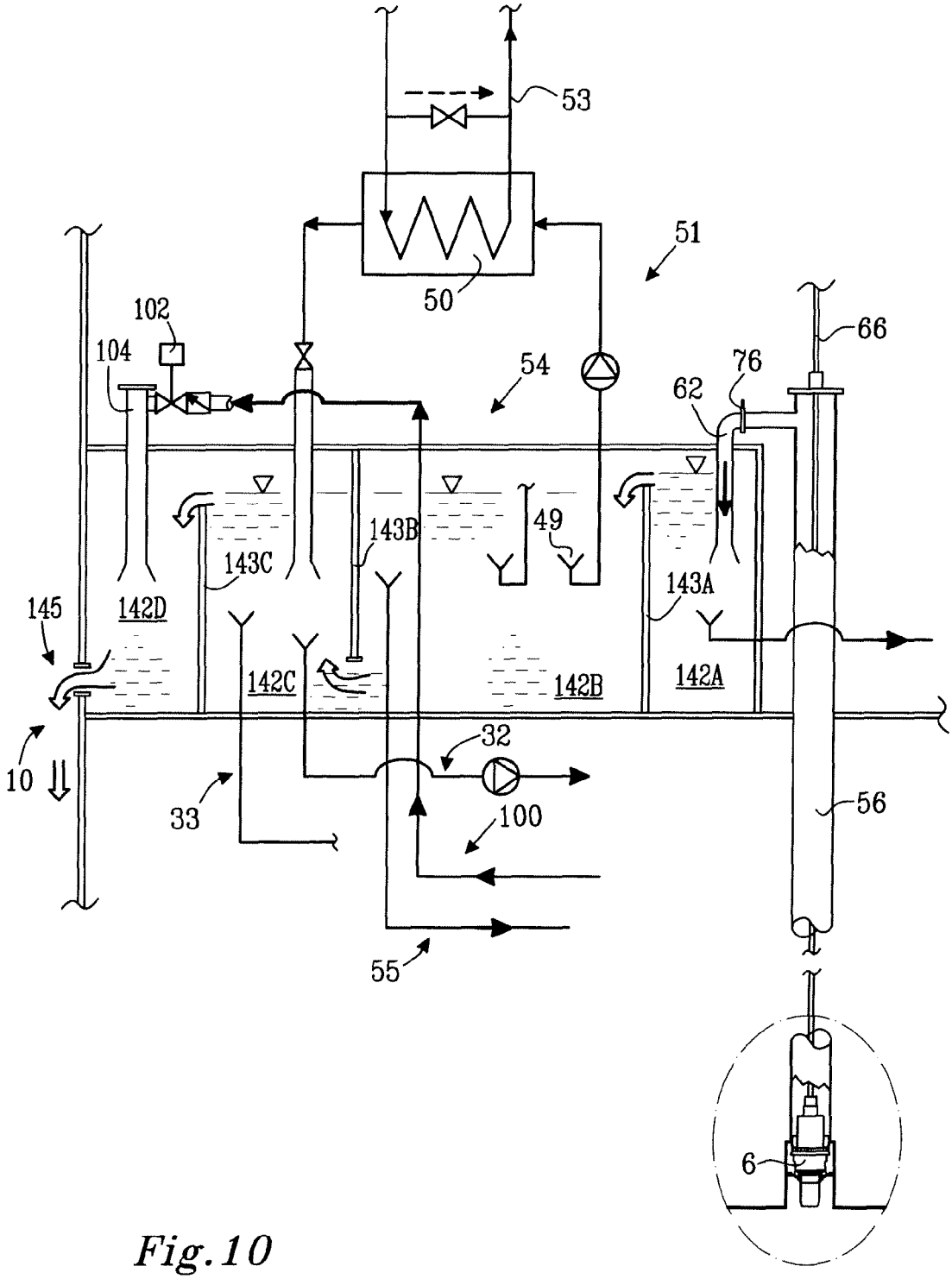
FIGS. 10, 11 and 12 disclose an intermediate tank of example embodiments.

FIG. 10 schematically illustrates a further implementation of an intermediate tank 54. As may be gleaned from FIG. 10, the intermediate tank 54 comprises a plurality of compartments 142A, 142B, 142C, 142D. In the implementation illustrated in FIG. 10, the intermediate tank is provided with four compartments 142A, 142B, 142C, 142D. In FIG. 10, two adjacent tank compartments 142A, 142B, 142C, 142D are separated from one another by means of a partition wall 143A, 143B, 143C. Each one of the partition walls 143A, 143B, 143C comprises an opening in order to provide the aforesaid fluid communication between the compartments 142A, 142B, 142C, 142D. In the FIG. 10 implementation of the intermediate tank 54, this has been achieved by designing the partition walls 143A, 143B, 143C such that they cover only a portion of the cross section of the intermediate tank 54. Moreover, in FIG. 10, the compartments 142A, 142B, 142C, 142D are arranged side-by-side which is a preferred arrangement of the compartments.

The first compartment 142A is connected to the first conduit portion which in FIG. 10 is exemplified by a first caisson 56 and a first curved pipe 62 with an outlet—which may be regarded as being comprised in a first conduit portion outlet—discharging into the first compartment 142A. The intermediate tank 54 further comprises a fourth compartment 142D which is associated with an intermediate tank outlet 145. It should be noted that the fourth compartment 142D together with the intermediate tank outlet 145 forms an overflow arrangement 10 of the intermediate tank, c.f. FIG. 9C. Since the overflow arrangement 10 by definition is not a part of the inlet conduit assembly 4 (the overflow arrangement 10 is in fluid communication with the inlet conduit assembly 4), the FIG. 10 overflow arrangement 10 comprising the fourth compartment 142D and the tank outlet 145 is not a part of the inlet conduit assembly 4, be it that the overflow arrangement 10 is located in a portion of the FIG. 10 inlet conduit assembly 4, namely the intermediate tank 54 thereof in a similar manner as the overflow arrangements 10 illustrated in FIGS. 9A, 9B and 9C. It should also be noted that the partition wall 143C partly delimiting the fourth compartment 142D—which compartment is a part of the FIG. 10 overflow arrangement—will prevent liquid contained in the fourth compartment to enter the remaining compartments 142A, 142B, 142C, i.e. the compartments of the intermediate tank 54 constituting a portion of the inlet conduit assembly 4. Consequently, liquid in the fourth compartment 142D will not be able to be introduced in the ballast tank 8. The intermediate tank 54 further comprises a tank flow direction, illustrated by arrows in FIG. 10, extending from the first conduit portion outlet to the intermediate tank outlet 145. As such, in the FIG. 10 implementation of the intermediate tank 54, the tank flow direction extends from the first compartment 142A to the fourth compartment 142D.

Moreover, a recirculation conduit assembly 51 is connected to the intermediate tank 54. The recirculation conduit assembly 51 comprises an inlet 49 which is located in an inlet tank compartment 142B of the plurality of tank compartments 142A, 142B, 142C, 142D. Furthermore, the recirculation conduit assembly 51 comprises an outlet discharging into an outlet tank compartment 142C of the plurality of tank compartments 142A, 142B, 142C, 142D. As may be gleaned from FIG. 10, the second tank compartment 142C is located downstream of the first tank compartment 142B in the tank flow direction.

In the FIG. 10 implementation of the intermediate tank 54, the first 142B and second 142C compartments are adjacent to one another. However, in another implementation of the intermediate tank 54, the first and second tanks may be separated by one or more compartments (not shown).

In FIG. 10, the recirculation conduit assembly 51 is connected to a heat exchanger 50 which is also connected to a conduit 53 for a cooling fluid, such as fresh water. However, the recirculation conduit assembly 51 may also, or instead, be connected to other facilities requiring a sea water circulation. However, it is generally desired that the sea water entering the outlet tank compartment 142C from the recirculation conduit assembly 51 is not heavily polluted. Moreover, it is generally desired—although not required—that the recirculation conduit assembly 51 requires a substantially constant sea water flow rate.

Moreover, a further conduit assembly 32 comprising a third pump assembly 34 is connected to the third compartment 142C. In addition, a water injection conduit assembly 33 is also connected to the third compartment 142C. Further, a second conduit portion 55, in fluid communication with at least one ballast tank (not shown), is connected to the second compartment, preferably at a location close to the partition wall 143B separating the second 142B and third 142C compartments. Additionally, a valve assembly 102 and a discharge outlet 104 connect the return pipe 100 to the fourth component of the intermediate tank 54.

Some advantages of the FIG. 10 implementation of the intermediate tank 54 will be presented hereinbelow with reference to FIG. 11 and FIG. 12.

Figure 11:
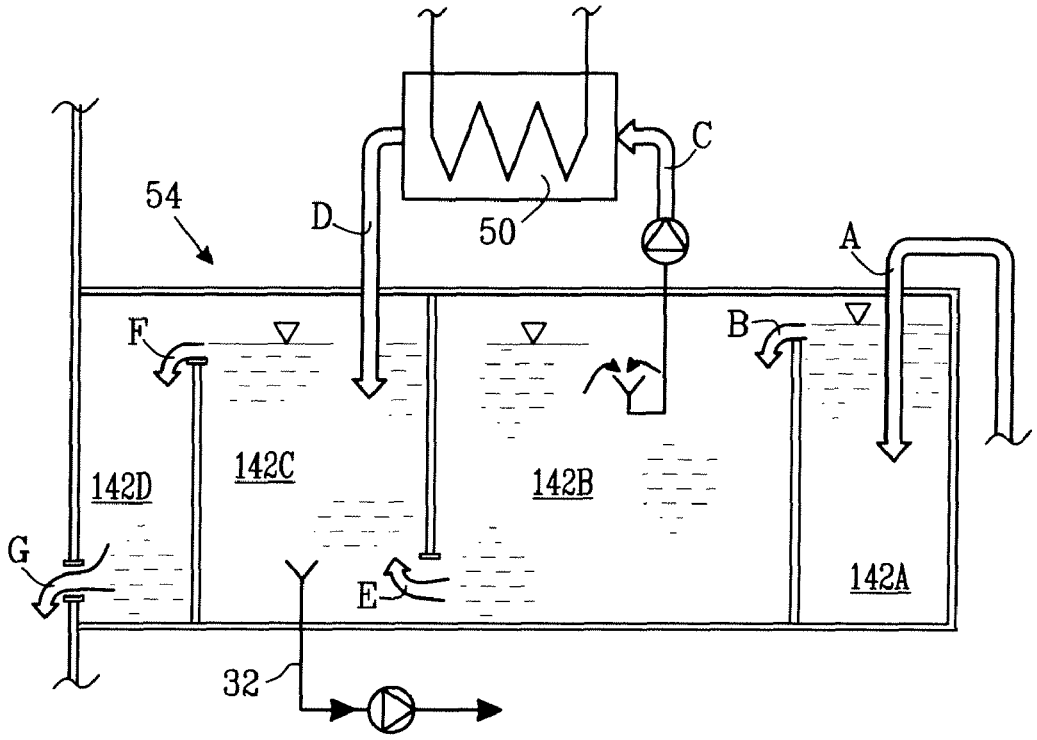

FIG. 11 illustrates the intermediate tank 54 when the sea water system, of which the tank 54 forms a part, is in a condition wherein only the recirculation conduit assembly 51 extracts sea water from the intermediate tank 54. As such, sea water is fed to the first compartment 142A of the intermediate tank 54 by the first conduit portion, see arrow A. Sea water then enters the second compartment 142B, see arrow B. One purpose of the first compartment 142A is to obtain a quiet flow to the second compartment 142B.

From the second compartment 142B, the recirculation conduit assembly 51 extracts sea water, see arrow C, and discharges sea water into the third compartment, see arrow D. Due to an opening in the second partition wall 143B, there may be a residual flow between the second and third compartments, see arrow E. If the sea water flow rate from the first to the second compartment (arrow B) exceeds the flow rate of the recirculation conduit assembly 51 extraction (arrow C) a positive flow rate may be obtained from the second to the third compartment. However, if the flow rate of the recirculation conduit assembly 51 extraction (arrow C) instead exceeds the sea water flow rate from the first to the second compartment (arrow B), a negative flow rate may be obtained between the second and third compartments such that water will travel from the third to the second compartment instead.

From the third compartment 142C, sea water will continue to flow into the fourth compartment 142D at a flow rate equal to the sum of the flow rates from the recirculation conduit assembly 51 discharge and the residual flow.

Figure 12:
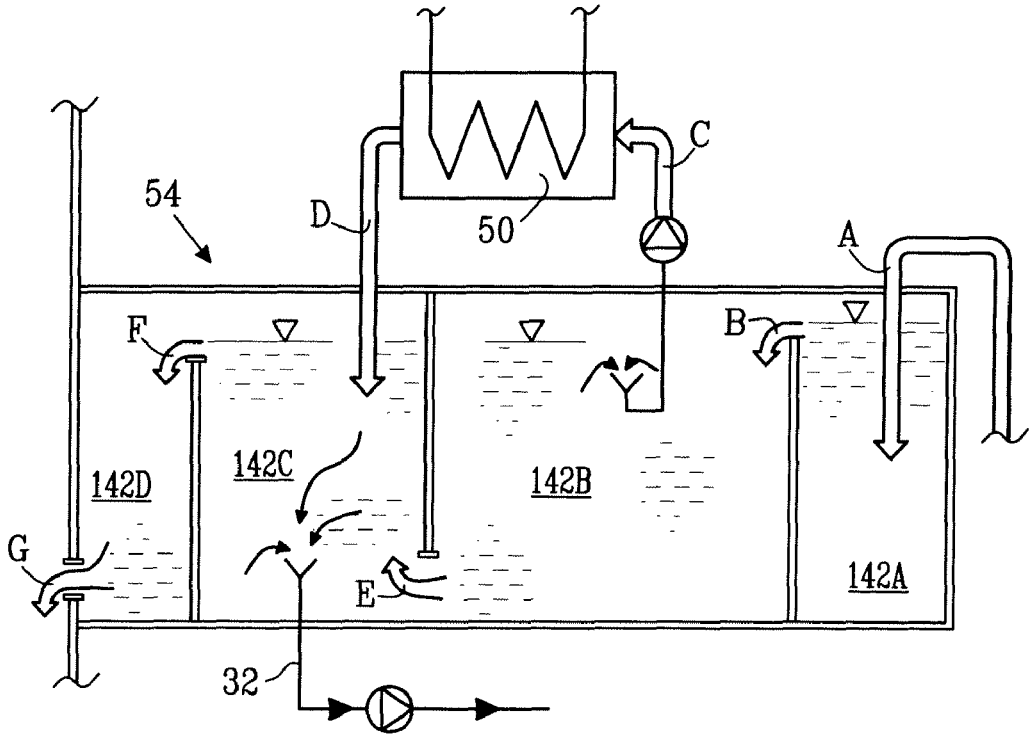

FIG. 12 illustrates the intermediate tank 54 when the sea water system also requires sea water for a fire fighting system 32. As may be gleaned from FIG. 12, the fire fighting system 32 will extract water from the third chamber 142C and will thus—at least to some extent—extract water which has been discharged by the recirculation conduit assembly 51. As such, the flow rate required from the first conduit portion to the intermediate tank 54 in order to feed the recirculation conduit assembly 51 as well as the fire fighting system 32 will be less than the sum of the flow rates through the two above assemblies 51, 32. This has some advantages, for instance that the first pump assembly (not shown in FIG. 12) of the first conduit portion does not have to produce a flow rate which equals the required flow rates of the two above assemblies 51, 32. Moreover, if the recirculation conduit assembly 51 requires a substantially constant flow rate, this may simplify the design of the first pump assembly, for instance in terms of the number of pumps in the first pump assembly and the flow rate range of each one of the aforesaid pumps.

If further conduit assemblies, such as the water injection conduit assembly 33, extract water from the third compartment 142C instead of or in addition to the fire fighting system 32, such further conduit assemblies will also extract some of the water discharged from the recirculation conduit assembly 51. It should be noted that the second conduit portion 55 could also be arranged to extract water from the third compartment 142C. However the second conduit portion 55 is preferably arranged in the second compartment 142B instead. This is since the water in the second compartment 142B generally has a lower temperature than the water in the third compartment 142C. Moreover, the risk of obtaining polluted water in the second compartment 142B is lower than in the third compartment 142C since at least some of the water in the third compartment 142C has passed an additional conduit assembly, namely the recirculation conduit assembly 51. Further, since the risk of obtaining polluted water is even lower in the first compartment 142A than in the second compartment 142B, a conduit to a system requiring as clean sea water as possible, such as a fresh water generation system, is preferably connected to the first compartment 142A.

Figure 13:
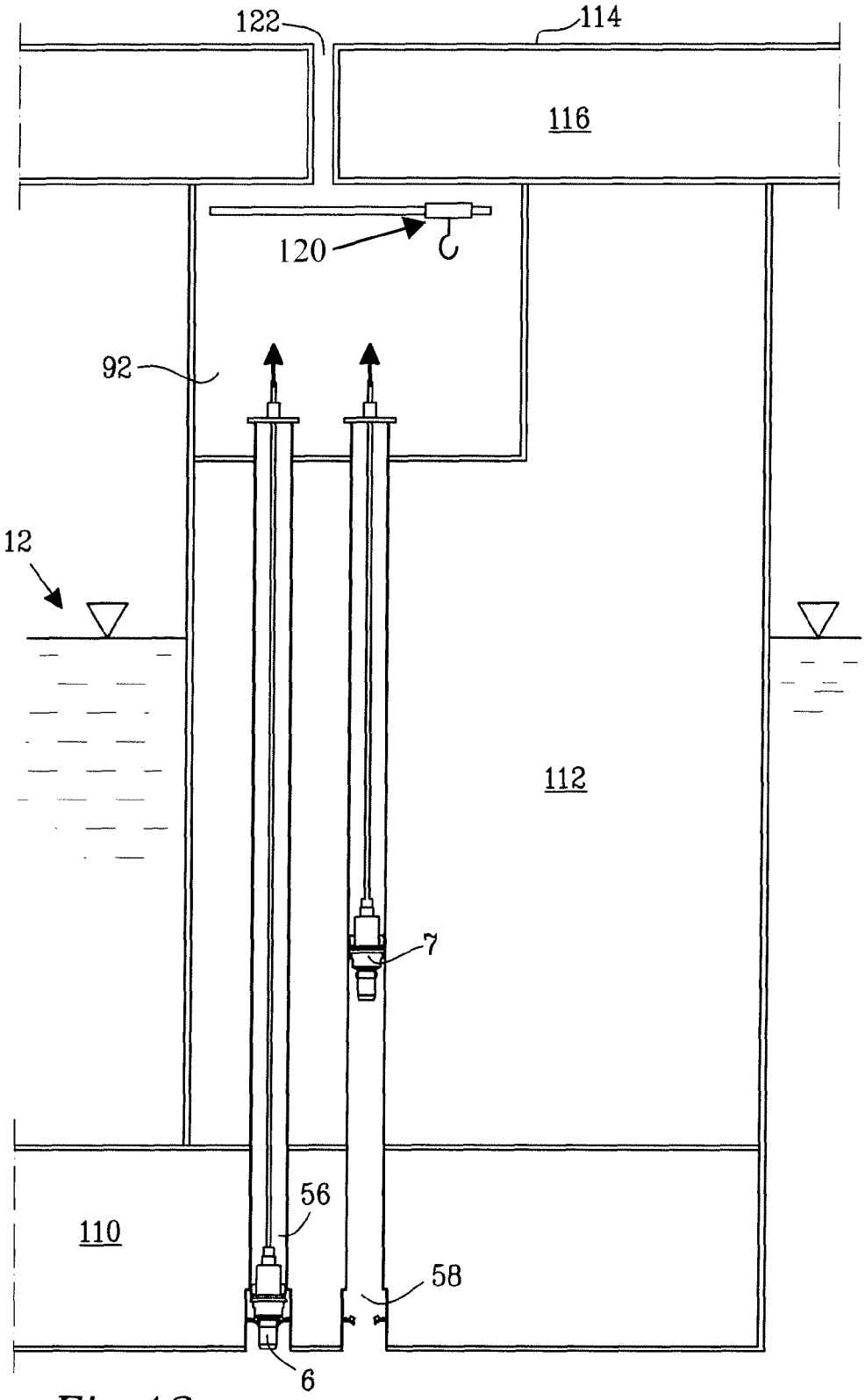
FIG. 13 schematically discloses a floating vessel according to example embodiments.

FIG. 13 schematically discloses a floating vessel according to example embodiments. The floating vessel is exemplary shown as a semi-submersible vessel in an operating position. The semi-submersible vessel comprises a float 110, a column 112 and a deck 114 on top of a deck box 116. A semi-submersible vessel may have four columns and may have two or more floats. In the operating position the still water surface 12 of the semi-submersible vessel is somewhere along the column 112, for instance about 30 meters above a bottom surface of the float 110.

In the column 112 there is a pump room 92. The pump room 92 is arranged in one quadrant of the column 112. Preferably, the pump room 92 is located in the quadrant of the column being closest to the centre of the vessel. This is since this quadrant generally is exposed to lower environmental forces and/or a lower risk of bringing impact by other floating objects as compared to the remaining three of the quadrants. When the semi-submersible vessel is in the operating position, a floor of the pump room is about 5 meters above the water line of the semi-submersible vessel. The pump room 92 is arranged below the deck box 116 and in the pump room 92 there may be arranged further parts of a sea water system, as shown in any one of FIGS. 1-9.

Two caissons 56, 58 extend through a bottom area of a hull of the semi-submersible vessel. A first pump 6 is arranged at a lower end of the first caisson 56 to pump sea water to the pump room 92 of the vessel. Inside the second caisson 58, well above is lower end, a first pump 7 is arranged. When the semi-submersible vessel is in an operating position, the first pump 7 in the second caisson 58 will be submersed in sea water because the still water surface 12 is above the first pump 7 and the second caisson 58 at its lower end is in open communication with ambient sea water. Of course the first pump 7 may alternatively be arranged at the lower end of the second caisson 58.

The number of caissons need not necessarily be two but could be any from 1 to 10 or more.

An advantage of the arrangement with first pumps 6, 7 at different heights in the caissons 56, 58 as disclosed in FIG. 9, is that pumps of different power can be used depending on position of the semi-submersible vessel. In the operating position, i.e. as shown, the vertical height the sea water needs to be transported to the pump room 92 is much less than when the semi-submersible vessel is in a transporting position. In a transporting position the draught is namely much lower and the still water surface of the vessel is somewhere along the float 110. In this position the vertical height the sea water has to be transported to the pump room 92 is much higher. Thus the first pump 6 at the lower end of the first caisson 56 has to be more powerful than the first pump 7 in the second caisson 58. As such, the semi-submersible vessel could be furnished with a first set of pumps (not shown) adapted to function appropriately when the vessel is in the transporting condition (i.e. at transit draught) as well as a second set of pumps (not shown) adapted to function appropriately when the vessel is in the operating position (i.e. at operational draught).

Each caisson 56, 58 extend from the bottom of the hull/float 110 to the pump room 92. Each caisson 56, 58 extend at least partially through the column 112. If the lower end is not closed by a lid and no pump pressure is built up inside the caisson 56, 58, the still water surface inside a caisson 56, 58 will be the same as the still water surface surrounding the vessel. Since each caisson 56, 58 extends to well above the still water level without any potential opening towards the inner space of the vessel, e.g. in the form of valves, flanges or connected pumps, the caissons 56, 58 do not present any danger from a leakage perspective. As such each caisson 56, 58 forms part of the hull of the vessel.

At its bottom end a respective caisson 56, 58 may be closed by means of a non-shown bottom lid. Such closing might need to be carried out from outside the hull, in a diving operation. When the lid is closed the caisson 56, 58 may be emptied from water and maintenance can be performed, e.g. internal painting of the caisson.

The pump room 92 is provided with its own drain pump 118 for spill water and oil. Such spill water and oil is pumped to a common spill and/or bilge water handling system of the semi-submersible vessel.

For handling pumps and for other heavy lifting operations a crane, e.g. an overhead traveling crane 120, is arranged in the pump room 92. In particular the crane 120 is used for lifting pumps in and out of the caissons 56, 58. A spare pump for immediate exchange with any malfunctioning pump in a caisson is suitably stored in the pump room 92.

For lifting long and/or heavy objects such as pumps and pipe sections into and/or out of the pump room 92, a shaft 122 extends from the deck 114 through the deck box 116.

On a floating vessel there are a number of heat exchangers. For instance engines and generators are cooled using cooling liquid. The cooling liquid must in turn be cooled in a suitable heat exchanger. Sea water is cold and readily available and therefore used as a heat exchange fluid for cooling other fluids. However, sea water from oceans contains salt and is thus corrosive, which puts high requirements on devices, e.g. pipes, valves and heat exchangers coming in contact with the sea water. Stainless steel or other materials with suitable surface treatment must be used in such devices. These are expensive materials.

In a pump room 92 as disclosed in FIGS. 7, 8 and 10 aboard a floating vessel according to example embodiments there may be arranged at least one heat exchanger for heat exchange between sea water and a further fluid. This further fluid is pumped through the heat exchanger in the pump room 92 and further to other users. Such users could either be devices to be cooled by the further fluid or further heat exchangers arranged in other places on the floating vessel. In the latter case the advantage is that the corrosive sea water need not be pumped all over the floating vessel for cooling purposes. Instead the further fluid, which could be fresh water, is used as the cooling fluid. Pipes, valves, heat exchangers etc can then be made from less expensive material. There may of course be arranged more than one heat exchanger in the pump room 92. Several heat exchangers may either cool the same further fluid or there may be several circuits of further fluids, each with its own heat exchanger.

Example embodiments may be combined as understood by a person skilled in the art. It is also understood by those skilled in the art that sea water used aboard a vessel e.g. for cooling or ballast may be further used. It is for instance possible to use the cooling or ballast water for water injection in an oil extraction process.

Figure 14:
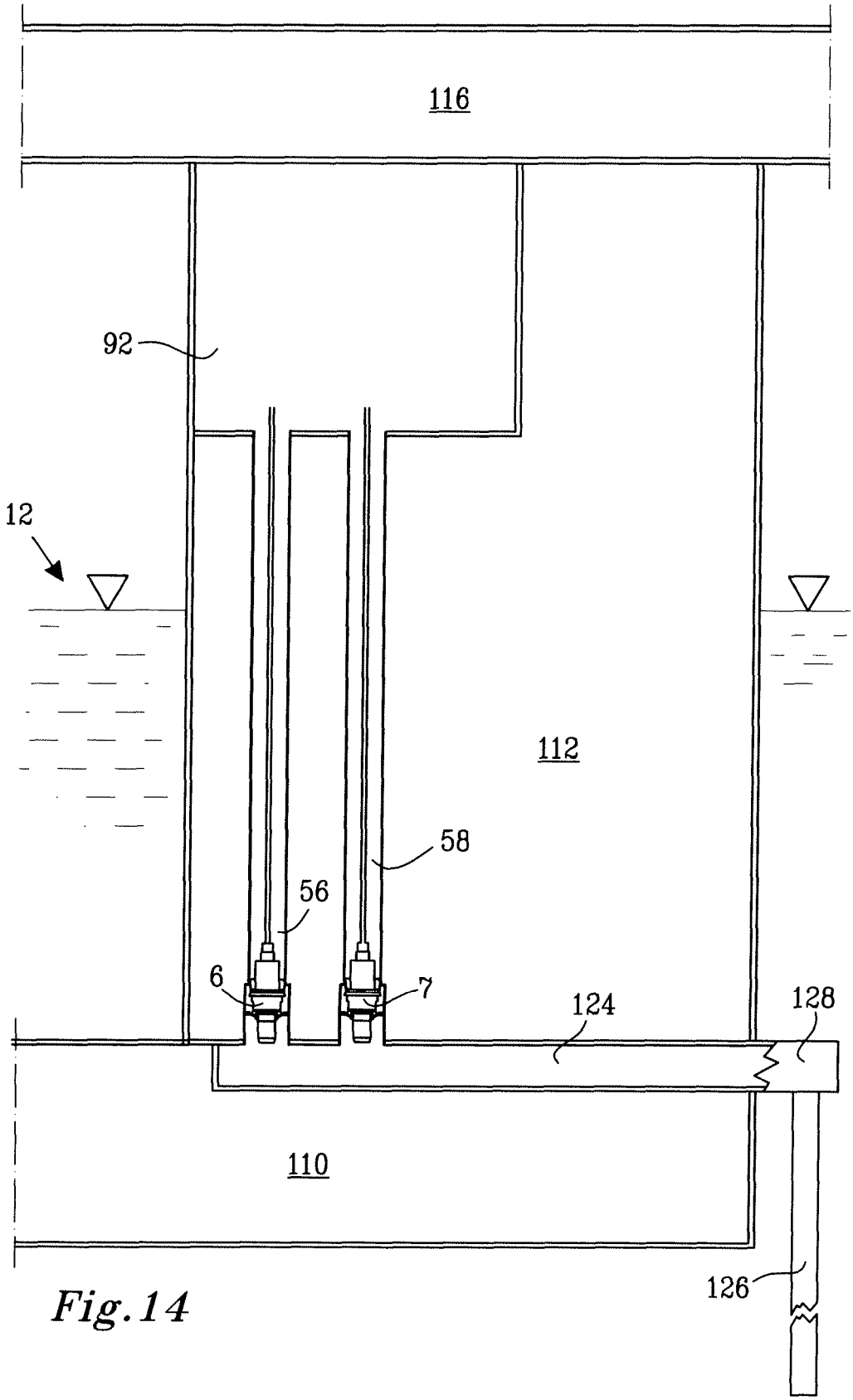
FIG. 14 schematically discloses a floating vessel according to example embodiments.

Even though the invention has been described with reference to example embodiments, many different alterations, modifications and the like will become apparent for those skilled in the art. A caisson may for instance be differently shaped. Instead of being straight a caisson may for instance extend straight down through a column and at its end have a 90 degree angle extending laterally through a hull. In a caisson two or more pumps may be arranged. Part of the inlet and outlet conduit assemblies may comprise several parallel flow paths, such as several caissons leading to an intermediate tank or a manifold or several conduits leading to one or more ballast tanks. Two caissons may be in fluid communication with each other. As such, purely by way of example, FIG. 14 illustrates a floating vessel wherein two caissons 56, 58 are connected to a common horizontally extending shaft 124. The shaft 124 is in turn connected to a hose 126 by means of a coupling arrangement 128. The hose 126 may be flexible.

Moreover, an overflow arrangement may be connected to each ballast tank and via the ballast tank be in fluid communication with the inlet conduit assembly. When outlets to ambient environment are described to be above a still water surface it is also envisaged that the physical outlet is below a still water surface but the conduit leading to the physical outlet extends to a level above a still water surface. A semi-submersible vessel may be provided with one or more sea water systems. A sea water system arranged in one column of a semi-submersible vessel may communicate with a sea water system arranged in a different column of the vessel. Under certain operating conditions it might then be suitable to let a first pump assembly of a sea water system in one column pump sea water to the other columns, in particular to an intermediate branch portion—such as an intermediate tank—of one or more of the other columns.

Therefore, it is to be understood that the foregoing is illustrative of various example embodiments and is not to be limited to the specific embodiments disclosed and that modifications to the disclosed embodiments, combinations of features of disclosed embodiments as well as other embodiments are intended to be included within the scope of the appended claims.

The invention claimed is:

1. A sea water system, comprising:

an inlet conduit assembly, a ballast tank and an overflow arrangement arranged in fluid communication with the inlet conduit assembly, the inlet conduit assembly providing fluid communication between ambient environment and the ballast tank;

a first pump assembly disposed in the inlet conduit assembly for pumping sea water through at least a first conduit portion of the inlet conduit assembly towards the ballast tank;

a second pump assembly in fluid communication with the ballast tank for pumping sea water from the ballast tank through an outlet conduit assembly arranged after the second pump assembly, characterized in that said overflow arrangement has an extension to a vertical level to thereby determine a maximum sea water pressure in said ballast tank, the second pump assembly and the outlet conduit assembly being separate from the inlet conduit assembly, wherein the inlet conduit assembly comprises, in sequence, the first conduit portion, an intermediate branch portion and a second conduit portion, wherein at least a second conduit assembly of the sea water system branches off from the intermediate branch portion, and wherein the intermediate branch portion is an intermediate tank adapted to hold sea water for further distribution.

2. The sea water system according to claim 1, wherein said outlet conduit assembly is adapted to discharge liquid into the overflow arrangement without feeding said liquid to said inlet conduit assembly.

3. The sea water system according to claim 1, wherein the further second conduit assembly comprises a third pump assembly.

4. The sea water system according to claim 1, wherein the overflow arrangement is connected to the intermediate tank.

5. The sea water system according to claim 1, wherein the overflow arrangement is formed such that a first overflow level provides a first outflow area from the intermediate tank and a second overflow level provides a second outflow area from the intermediate tank, said second outflow area being greater than said first outflow area.

6. The sea water system according to claim 5, wherein the first outflow area is formed by a recess in an upper edge of a portion of the overflow arrangement and/or formed by one or more through holes in a portion of the overflow arrangement.

7. The sea water system according to claim 1, wherein said intermediate tank comprises a plurality of tank compartments in fluid communication with one another.

8. The sea water system according to claim 7, wherein said first conduit portion comprises a first conduit portion outlet discharging into said intermediate tank, said intermediate tank further comprising an intermediate tank outlet, said intermediate tank comprising a tank flow direction extending from said first conduit portion outlet to said intermediate tank outlet, said sea water system further comprising a recirculation conduit assembly comprising an inlet being located in an inlet tank compartment of said plurality of tank compartments and an outlet discharging into an outlet tank compartment of said plurality of tank compartments, said outlet tank compartment being located downstream of said inlet tank compai tment in said tank flow direction.

9. The sea water system according to claim 1, wherein the intermediate branch portion is a manifold, from which the second conduit assembly branches off, and wherein the first pump assembly is adapted to pump sea water through the manifold and the second conduit portion to the ballast tank.

10. The sea water system according to claim 1, further comprising a floating vessel, wherein the floating vessel has a hull forming part of an outer skin of the floating vessel.

11. The sea water system according to claim 10, further comprising a caisson, wherein the caisson extends through a portion of the hull which is adapted to be located below a still water surface of the floating vessel, the caisson forming an integral part of the outer skin of the floating vessel.

12. The sea water system according to claim 11, wherein the first pump assembly comprises a submersible pump arranged in the caisson.

13. The sea water system according to claim 11, wherein the floating vessel comprises a substantially vertical column, inside which the caisson extends.

14. The sea water system according to claim 11, wherein the caisson forms at least a part of the inlet conduit assembly.

15. The sea water system according to claim 11, wherein the caisson extends to the intermediate branch portion.

16. The sea water system according to claim 10, wherein the intermediate branch portion is arranged above a still water surface of the floating vessel.

17. The sea water system according to claim 13, wherein the intermediate branch portion is arranged in a pump room.

18. The sea water system according to claim 17, wherein the pump room is arranged in the column of the floating vessel.

19. The sea water system according to claim 17, further comprising a heat exchanger arranged in the pump room, wherein the heat exchanger is for heat exchange between sea water and a second fluid.

20. The sea water system according to claim 17, further comprising a crane arranged in the pump room, wherein the crane is for lifting the first pump assembly.

21. The sea water system according to claim 17, further comprising a lifting shaft which extends between the pump room and a level above the pump room.

22. The sea water system according to claim 17 wherein, the pump room has an overflow outlet and/or a drain pump.

23. The sea water system according to claim 10, wherein the floating vessel is a semi-submersible vessel.

24. The sea water system according to claim 10, further comprising a bilge water system of the floating vessel connected to the second pump assembly, the second pump assembly being adapted for pumping bilge water through the outlet conduit assembly.

25. A sea water system, comprising:

an inlet conduit assembly, a ballast tank, and an overflow arrangement in fluid communication with each other and an ambient environment, wherein the overflow arrangement is adapted to determine a maximum sea water pressure in the ballast tank;

a first pump assembly disposed in the inlet conduit assembly and adapted to transfer sea water through at least a first conduit portion of the inlet conduit assembly toward the ballast tank; and a second pump assembly in fluid communication with the ballast tank adapted to transfer sea water from the ballast tank through an outlet conduit assembly disposed downstream from the second pump assembly, wherein the second pump assembly and the outlet conduit assembly are separate from the inlet conduit assembly, wherein the inlet conduit assembly comprises, in sequence, the first conduit portion, an intermediate branch portion, and a second conduit portion, wherein at least a second conduit assembly of the sea water system branches off from the intermediate branch portion, wherein the intermediate branch portion is an intermediate tank adapted to hold sea water for further distribution, and wherein the overflow arrangement is connected to the intermediate tank.

26. The sea water system of claim 25, further comprising:

a floating vessel; and a caisson, wherein the caisson extends through a portion of a hull of the floating vessel and is adapted to be located below a still water surface of the floating vessel.

27. The sea water system of claim 26, wherein the first pump assembly comprises a submersible pump arranged in the caisson.

28. A sea water system, comprising:

an inlet conduit assembly, a ballast tank, and an overflow arrangement in fluid communication with each other and an ambient environment, wherein the overflow arrangement is adapted to determine a maximum sea water pressure in the ballast tank;

a first pump assembly disposed in the inlet conduit assembly and adapted to transfer sea water through at least a first conduit portion of the inlet conduit assembly toward the ballast tank; and a second pump assembly in fluid communication with the ballast tank adapted to transfer sea water from the ballast tank through an outlet conduit assembly disposed downstream from the second pump assembly, wherein the second pump assembly and the outlet conduit assembly are separate from the inlet conduit assembly, wherein the inlet conduit assembly comprises, in sequence, the first conduit portion, an intermediate branch portion, and a second conduit portion, wherein at least a second conduit assembly of the sea water system branches off from the intermediate branch portion, wherein the intermediate branch portion is an intermediate tank adapted to hold sea water for further distribution, and wherein the overflow arrangement is formed such that a first overflow level provides a first outflow area from the intermediate tank and a second overflow level provides a second outflow area from the intermediate tank, the second outflow area being greater than the first outflow area.

29. The sea water system of claim 28, wherein the first pump assembly comprises a submersible pump.

* * * * *